US005345793A

United States Patent [19]

Sharp

[11] Patent Number: 5,345,793

[45] Date of Patent: Sep. 13, 1994

[54] DRIVE SYSTEM FOR AN AUTOMATIC WASHER

[75] Inventor: Brenner M. Sharp, St. Joseph Township, Berrien County, Mich.

[73] Assignee: Whirlpool Corporation, Benton Harbor, Mich.

[21] Appl. No.: 78,510

[22] Filed: Jun. 21, 1993

[51] Int. Cl.[5] ..... D06F 37/30

[52] U.S. Cl. ..... 68/133; 68/23.7; 475/345; 475/901; 475/902

[58] Field of Search ..... 68/23.6, 23.7, 133; 475/344, 345, 901, 902

[56] References Cited

U.S. PATENT DOCUMENTS

| | | | |
|---|---|---|---|
| 3,081,648 | 3/1963 | Duer | 475/345 |
| 3,154,970 | 11/1964 | Gebhardt et al. | 475/901 X |
| 4,317,343 | 3/1982 | Gerry | 68/23.7 |
| 4,509,390 | 4/1985 | Hockmuth | 475/344 X |
| 4,651,575 | 3/1987 | Morishita et al. | 74/7 E |
| 4,712,451 | 12/1987 | Morishita et al. | 74/801 |
| 4,715,243 | 12/1987 | Morishita et al. | 74/434 |
| 4,869,455 | 9/1989 | Weeks | 248/674 |
| 4,969,341 | 11/1990 | Burk et al. | 68/23.7 |

FOREIGN PATENT DOCUMENTS

| | | | |
|---|---|---|---|
| 82046 | 4/1986 | Japan | 475/345 |
| 18480 | 5/1986 | Japan | 68/23.6 |
| 74293 | 3/1990 | Japan | 68/133 |
| 292550 | 12/1990 | Japan | 475/901 |

*Primary Examiner*—Philip R. Coe
*Attorney, Agent, or Firm*—Joel M. Van Winkle; Stephen D. Krefman; Robert O. Rice

[57] ABSTRACT

In an automatic washer drive system, a planetary gear arrangement is provided including an input drive shaft being drivingly connected to a motor at one end and having a sun gear interconnected with a second end. A plurality of cylindrical plastic planet gears are disposed around and engage the sun gear. A plastic unitary carrier member rotatably supports the planet gears and further interconnects with an output drive shaft for causing rotation of an agitator. A gear housing surrounds the cylindrical planetary gears which engage an internal ring gear disposed on an inner peripheral surface of the gear housing. The plastic unitary carrier member is configured to include a plate portion which extends outwardly in the radial direction with respect to the output drive shaft. A plurality of the cylindrical pin portions extend from the plate portion in the longitudinal direction with respect to the output drive shaft. These cylindrical pin portions provide the rotatable support of the cylindrical planet gears. A boss portion extends from a center portion of the plate portion and includes internal grooves for receiving splines disposed on the output drive shaft such that the unitary carrier member and output drive shaft are rigidly interconnected.

23 Claims, 3 Drawing Sheets

DRIVE SYSTEM FOR AN AUTOMATIC WASHER

BACKGROUND OF THE INVENTION

The present invention relates to drive systems for automatic clothes washers, and more particularly to improvements in a planetary gear drive system for a vertical axis washer.

In an automatic washer, drive systems are utilized for drivingly interconnecting a motor with a perforate wash basket acting as a clothes receiving receptacle and an agitator disposed within the wash basket. Automatic washers may be afforded with a direct drive system between a reversible motor and the agitator/wash basket so that the washer will be able to selectively operate in a "agitate" mode, wherein the agitator is oscillated while the basket is held stationary, and in a water extraction or "spin" mode, wherein the agitator and basket are spun together. Typically, the drive system includes a clutch mechanism to selectively operate between the "agitate" mode and the "spin" mode.

In the "agitate" mode, the motor is in a reversing drive mode wherein drive is established to the agitator at a rate of rotation much reduced over the rate of rotation of the motor. The drive system may further include therefore, a gear reduction mechanism such as a planetary gear arrangement.

Previously known drive systems including planetary gear arrangements are complicated mechanisms, requiring metallic components and precisely machined mating surfaces. For example, U.S. Pat. No. 4,317,343, discloses a drive system including a planetary gear arrangement in an automatic washer. This reference teaches the use of a metallic gear casing surrounding a metallic carrier assembly having an upper frame and a lower plate and axle pins supporting stepped pinion gears. In this configuration, in order to properly orientate the stepped pinion gears and to ensure that the axle pins are securely fixed to the carrier assembly, the upper frame and lower plate portions of the carrier assembly must be precisely machined. In particular, fabricating the holes in the upper frame into which the axle pins are inserted require a high degree of precision machining.

Commonly assigned U.S. Pat. No. 4,969,341 also discloses a drive system for an automatic washer. Included in the disclosed drive system is a gear reduction mechanism or planetary gear arrangement. This reference, however, also teaches the use of a metallic carrier plate and a plurality of metallic axle pins for supporting a plurality of planet gears. As discussed above, this configuration of a planetary gear arrangement requires precision machined parts which are relatively very costly. Furthermore, U.S. Pat. No. 4,969,341 also teaches the use of a combination of thermoplastic parts and metallic parts in the construction of the planetary gear arrangement. This use of dissimilar materials for the components in the planetary gear arrangement results in differing thermal expansion characteristics between the planetary gear components. This difference in thermal expansion may result in excessive spacing between components at elevated temperatures such that the performance of the planetary gear arrangement is degraded.

It would therefore be an improvement in the art if a less expensive planetary gear arrangement was provided which did not require costly high precision machining operations. Further, it would also be highly desirable to overcome the problems of differentials in the thermal expansion of various gear components.

SUMMARY OF THE INVENTION

Accordingly, one object of the present invention is to provide a planetary gear assembly for an automatic washer having no component requiring precision machining.

Another object is to provide a planetary gear assembly wherein the primary components have similar thermal expansion characteristics.

Still another object is to provide a unique unitary carrier member for supporting a plurality of planetary gears having a configuration capable of supporting the relatively high forces experienced during operation.

Yet another object is to provide planet gears having sufficient resiliency such that the planet gears may deform when a load is applied to allow the carrier member to control the working pitch circle or pitch diameter of the planet gears.

To achieve the foregoing and other objectives, and in accordance with the purposes of the present invention, a planetary gear arrangement for use in an automatic washer having a vertical axis agitator, a concentrically mounted wash basket, and a motor drivingly connected to the agitator to selectively oscillate or rotate the agitator about a vertical axis, is provided. Accordingly, the planetary gear arrangement includes an input drive shaft being drivingly connected to the motor at one end and having a sun gear formed into a second end. A plurality of cylindrical plastic planet gears are disposed around and engage the sun gear. A unitary plastic carrier member rotatably supports the planet gears and further interconnects with an output drive shaft for causing rotation of the agitator. A gear housing surrounds the cylindrical planetary gears which engage an internal ring gear disposed on an inner peripheral surface of the gear housing.

The unitary plastic carrier member is configured to include a plate portion which extends outwardly in the radial direction with respect to the output drive shaft. A plurality of cylindrical hollow pin portions extend from the plate portion in the longitudinal direction with respect to the output drive shaft. A boss portion extends from a center portion of the plate portion and includes internal grooves for receiving splines disposed on the output drive shaft such that the carrier member and output drive shaft are rigidly interconnected.

During operation, the cylindrical hollow pin portion provide rotatable support of the cylindrical planet gears. Furthermore, to ensure optimum engagement between the sun gear, planet gears and the internal ring gear under all operating conditions, the cylindrical planet gears are configured to allow radial compliance or resiliency such that planet gears deform under load and the pitch diameter of the planet gears is controlled by the cylindrical hollow pin portions of the carrier member.

DESCRIPTION OF THE PREFERRED EMBODIMENT

Figure 1:
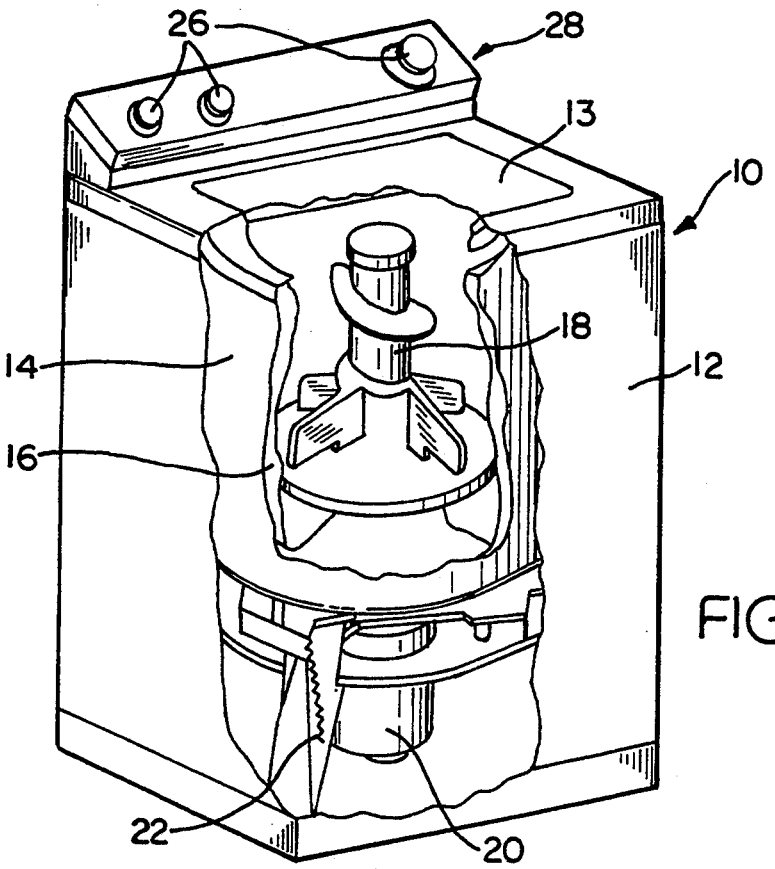
FIG. 1 is a perspective view of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to drive it in an oscillatory or rotary manner, and is also selectively connectable to the basket 16 for simultaneous rotation with the agitator 18. The assembly of the tub 14, wash basket 16, agitator 18, and motor 20 is mounted on a suspension system 22. A plurality of controls 26 are provided on a control console 28 for automatically operating the washer through a series of washing, rinsing, and liquid extracting steps.

Figure 2:
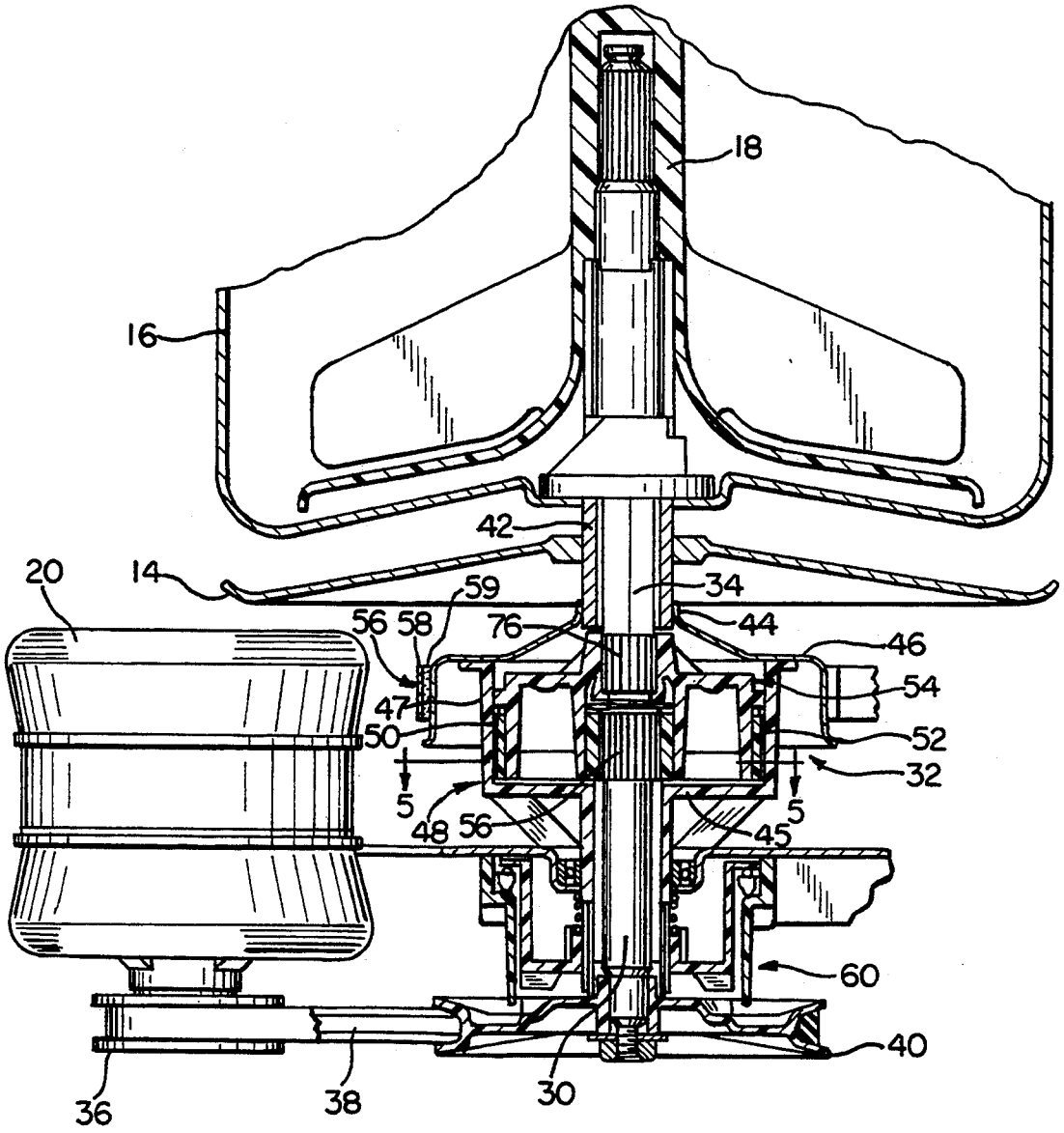
FIG. 2 is a side section view of the agitator and drive system of the washer of FIG. 1.
Figure 4:
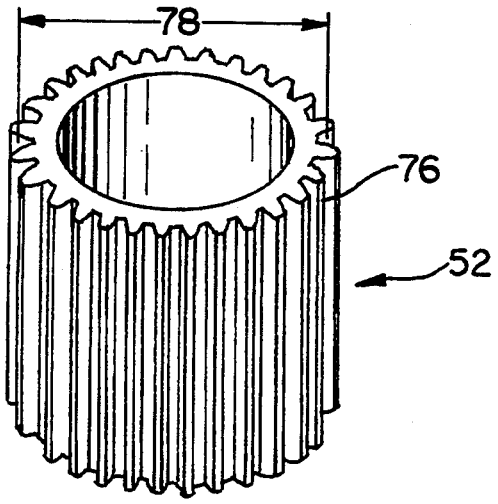
FIG. 4 is a perspective view of a cylindrical planet gear of the present invention.

The drive mechanism is shown in greater detail in FIG. 2, where it is seen that the motor 20 is connected through a drive shaft 30 to a planetary gear assembly 32 and to a vertical shaft 34 connected to the agitator 18. In this particular drive arrangement, the motor 20 may be a permanent split capacitor (PSC) motor, and is connected through a drive pulley 36 and a belt 38 to drive a driven pulley 40 affixed to the bottom of the drive shaft 30. The wash basket 16 is connected to a spin tube 42, which is in turn connected to a flanged portion 44 of a hub member 46. A gear housing 48 is rigidly interconnected with the hub 46 and includes a flange portion 45 and a cylindrical portion 47. An internal gear ring 50, disposed on the inner peripheral surface of the cylindrical portion 47 of the gear housing 48, interacts with a plurality of cylindrical planet gears 52. The vertical shaft 34 is connected to the planet gears 52 through the use of a connecting carrier member 54 which rotatably supports the planet gears 52. A sun gear 56 is directly connected to the drive shaft 30. The sun gear 56 may be formed on the outer peripheral surface of the drive shaft such that the sun gear is integral with the drive shaft.

When the washer is operating in the agitate mode, the motor 20 is operated in a reversing fashion which causes the drive shaft 30 to oscillate, thus driving the sun gear 56 in alternating opposite directions. The agitator 18 is therefore oscillated through its connection with the planet gears 52. The wash basket is held stationary during this operation, and to provide the means for holding the basket stationary, a band brake mechanism shown generally at 56 may be provided. The band brake mechanism 56 includes a brake band 58 having a high friction interior lining 59 which is engageable with at least a portion of the circumference of the hub 46 connected to the basket 16. The band brake 56 may be constructed and actuated as disclosed in commonly assigned U.S. Pat. No. 4,891,959 filed Jul. 1, 1988, the specification of which is incorporated by reference herein.

Generally, in the agitate mode, the agitator 18 is oscillated through an angle of approximately 270° to 300° during each stroke. Often, it is desirable to hold the wash basket fixed relative to the wash tub during the agitate mode. This is accomplished by leaving the brake mechanism 56 in an "on" condition. However, during the water extraction step, the basket 16 is spun with the agitator 18. During this step the brake mechanism 56 is released from frictional engagement with the hub 44.

A clutch mechanism is required to provide a way of switching between oscillatory movement of the agitator relative to the basket, and spinning of the agitator with the basket. The present invention contemplates an improved and simplified clutch assembly 60 which may be constructed and actuated as disclosed in commonly assigned and copending U.S. Pat. No. 4,969,341 and U.S. Pat. No. 5,172,5734, the specifications of which are incorporated by reference herein.

Figure 3:
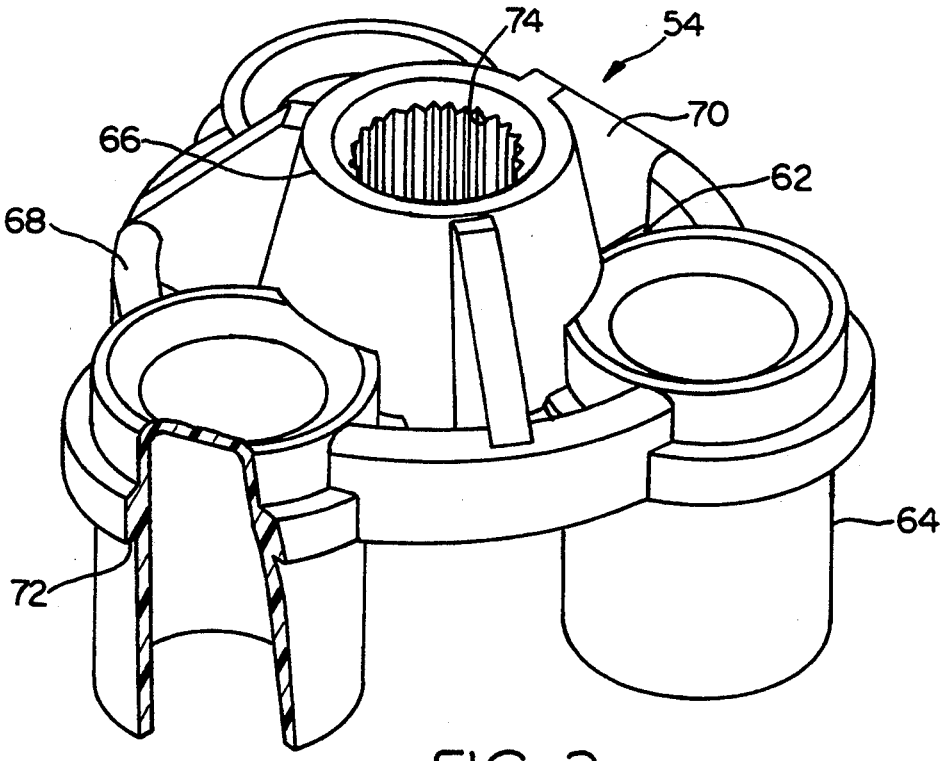
FIG. 3 is a partially cut away perspective view of a carrier member of the present invention.

The carrier member 54 and one of the cylindrical planet gears are shown in greater detail in FIG. 3. The carrier member 54 includes a plate portion 62, a plurality of cylindrical hollow pin portions 64 and a center boss portion 66. A rib 68 is disposed along the peripheral edge of the plate portion 62 and a plurality of reinforcement gussets 70 interconnect the center boss portion 66 with the plate portion 62 and the peripheral rib 68. The plurality of cylindrical hollow pin portions 64 are configured to received the cylindrical planet gears 52 and include a stop surface for limiting the axial movement of the cylindrical planet gears 52 along the cylindrical hollow pin portions 64. The center boss portion 66 includes a plurality of grooves 74 for receiving a plurality of splines 76 (shown in FIG. 2) disposed on the lower end of the vertical shaft 34 such that the carrier member 54 and the vertical shaft 34 are rigidly interconnected.

As contemplated by the inventors, the carrier member 54 is a single body formed from a plastic resin such as a 25% glass filled Acetal copolymer. The gear housing 48 is also contemplated to be formed from a plastic resin material having a similar thermal expansion property as the material used for forming the carrier member 54 such as the 25% glass filled Acetal copolymer. In this fashion, therefore, the largest components of the gear assembly have similar thermal expansion properties. During operation of the drive mechanism, the planet gear assembly 32 increases in temperature due to friction between moving components. However, as a result of the similarity in materials of these primary components of the planetary gear assembly, the relative fit and spacing between different components of the planetary gear assembly remains substantially the same at all temperatures.

The cylindrical planet gears 52, however, must be formed from a plastic resin having highly favorable wear characteristics or properties when running on the material used for forming the carrier member 54. One such material may be Nylon 6/6. This material provides an excellent wear surface when running on glass filled Acetal but does not have similar thermal expansion characteristics as the material used for forming the carrier member 54 and further, may lack dimensional stability due to its hydrophillic nature. This problem may be overcome, however, in the present invention by relying on the dimensionally stable and rigid carrier member 54 as described below.

The cylindrical planet gears 52 are relatively thin cylindrical wall members having a plurality of axially orientated teeth 76 disposed on the outer peripheral surface of the thin cylindrical wall members for engaging the sun gear 56 and the inner gear ring 50. The cylindrical planet gears 52, therefore, are configured such that the diameter of the pitch circle or pitch diameter 78 may be controlled by the outer diameter of the cylindrical hollow pin portions 64 of the carrier member 54. In operation, the cylindrical planet gears 52 resiliently deform under the loads applied by the sun gear 56 and the internal gear ring 50 and are wrapped around the circumference of the cylindrical hollow pins 64. In this fashion, therefore, the pitch diameter of the cylindrical planet gears 52 is independent of the diameter of the planet gears 52 but is related instead to the outer diameter of the cylindrical hollow pins 64.

Figure 5:
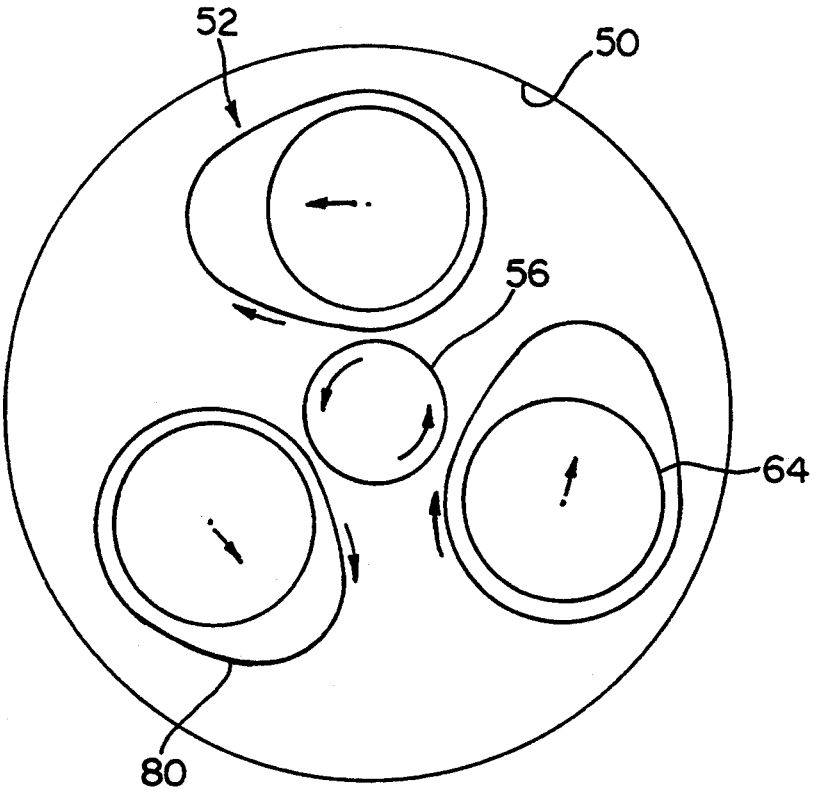
FIG. 5 is a sectional view taken along lines 5—5 of FIG. 2 with the deformation of the cylindrical planet gears greatly exaggerated.

This resilient deformation of the planet gears in operation is clearly shown in FIG. 5, where the deformation of the planet gears 52 is greatly exaggerated for illustrative purposes. As discussed above, the pitch diameter 78 is controlled by the outer diameter of the hollow pins 64. In operation, as the sun gear 56 rotates, the planet gears 52 are caused to rotate as well. In the condition wherein the ring gear 50 is held stationary, the carrier member 54 rotates at a reduced RPM from that of the sun gear 56. During operation, the planet gears 52 are resiliently wrapped around a portion of the circumference of the hollow pins 64, while excess circumferential distance of the planet gears 52 gathers as a loop around the hollow pin 64. In this fashion, therefore, tight control of the dimensions of the planet gear 52 are not required and the problem of a lack of dimensional stability caused by water absorption is overcome.

The planetary gear system of the present invention, therefore, provides a unitary carrier member and cylindrical planetary gear configuration which allowed the use of plastic resin for forming the carrier member and the planetary gears. This plastic resin use had previously been precluded by the prior art which taught carrier plate and pin assemblies which experienced extremely high stresses due to their configuration. Simply substituting plastic resin into the prior art planetary gear assemblies would result in part failure and inoperability of the gear assembly. For the present invention, therefore, inventive effort was required to develop a unique carrier member and planetary gear assembly capable of functioning under the high forces experienced during operation.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim:

1. A gear reduction mechanism comprising:

a rotary input drive shaft;

a sun gear interconnected with said input drive shaft;

a plurality of cylindrical planet gears engaging said sun gear;

an output vertical shaft;

a unitary carrier member being formed of plastic resin and having integral means for rotatably supporting said cylindrical planet gears and further having means for interconnecting with said output vertical shaft for causing rotation of said output vertical shaft; and a gear housing having an internal gear ring surrounding said cylindrical planet gears, said plurality of cylindrical planet gears engaging said internal gear ring member.

2. A gear reduction mechanism according to claim 1 wherein said unitary carrier member further comprises:

a plate portion extending outwardly in the radial direction with respect to said output vertical shaft;

a plurality of cylindrical hollow pin portions extending from said plate portion in the longitudinal direction with respect to said output vertical shaft, said cylindrical hollow pin portions rotatably supporting said cylindrical planet gears; and a boss portion extending from said plate portion in the longitudinal direction with respect to said output vertical shaft, said boss portion being interconnected with said output vertical shaft for causing rotation of said output vertical shaft.

3. The gear reduction mechanism according to claim 2 wherein said plurality of cylindrical hollow pin portions have an outer diameter substantially equal to the pitch diameter of said plurality of cylindrical planet gears.

4. A gear reduction mechanism according to claim 1 wherein said drive shaft has an outer peripheral surface and said sun gear is integrally formed on outer peripheral surface of said drive shaft.

5. A gear reduction mechanism according to claim 1 wherein said gear housing further comprises:

a flange portion; and a cylindrical portion extending from said flange portion in the longitudinal direction with respect to said input drive shaft, said cylindrical portion having an inner peripheral surface, said internal gear ring being formed on said inner peripheral surface.

6. A gear reduction mechanism according to claim 1 wherein each of said plurality of cylindrical planet gears consist of:

a thin cylindrical wall member having an outer peripheral surface; and a plurality of axially oriented teeth disposed on said outer peripheral surface of said thin cylindrical wall member.

7. A gear reduction mechanism according to claim 6 wherein each of said plurality of cylindrical planet gears are formed from a plastic resin and are configured such that said thin cylindrical wall deforms during operation such that the pitch diameter of the cylindrical planet gears is controlled by the unitary carrier member means for rotatably supporting said cylindrical planet gears.

8. A gear reduction mechanism according to claim 1 wherein said plurality of cylindrical planet gears, said unitary carrier member and said gear housing are all formed from plastic resins having equivalent coefficients of thermal expansion such that the spacing between the components remains constant over a range of temperatures.

9. An automatic washer having a vertical axis agitator, a concentrically mounted wash basket, a motor drivingly connected to said agitator to selectively oscillate or rotate said agitator about said vertical axis, and a drive system for drivingly interconnecting said motor with said agitator, said drive system comprising:

an input drive shaft having a first end interconnected with said motor and a second end;

a sun gear interconnected with said second end of said input drive shaft;

a plurality of cylindrical planet gears engaging said sun gear;

an output vertical shaft;

a unitary carrier member being formed of plastic resin and having integral means for rotatably supporting said cylindrical planet gears and further having means for interconnecting with said output vertical shaft for causing rotation of said output vertical shaft;

a gear housing having an inner peripheral surface; and an internal gear ring formed on said inner peripheral surface of said gear housing, said plurality of cylindrical planet gears engaging said internal gear ring.

10. An automatic washer according to claim 9 wherein said unitary carrier member further comprises:

a plate portion extending outwardly in the radial direction with respect to said output vertical shaft;

a plurality of cylindrical hollow pin portions extending from said plate portion in the longitudinal direction with respect to said output vertical shaft, said cylindrical hollow pin portions rotatably supporting said cylindrical planet gears; and a boss portion extending from said plate portion in the longitudinal direction with respect to said output vertical shaft, said boss portion being interconnected with said output vertical shaft for causing rotation of said output vertical shaft.

11. The automatic washer according to claim 10 wherein each of said plurality of cylindrical hollow pin portions have an outer diameter and further wherein the ratio of the pitch diameter of each of said plurality of said cylindrical planet gears to said outer diameter of each of said plurality of cylindrical hollow pin portions is less than 1.5.

12. An automatic washer according to claim 9 wherein said input drive shaft has an outer peripheral surface and said sun gear is integrally formed on outer peripheral surface of said input drive shaft.

13. An automatic washer according to claim 9 wherein said gear housing further comprises:

a flange portion; and a cylindrical portion extending from said flange portion in the longitudinal direction with respect to said input drive shaft, said cylindrical portion having an inner peripheral surface, said internal gear ring being formed on said inner peripheral surface.

14. An automatic washer according to claim 9 wherein each of said plurality of cylindrical planet gears consist of:

a thin cylindrical wall member having an outer peripheral surface; and a plurality of axially oriented teeth disposed on said outer peripheral surface of said thin cylindrical wall member.

15. An automatic washer according to claim 14 wherein each of said plurality of cylindrical planet gears are formed from a plastic resin and are configured such that said thin cylindrical wall deforms during operation such that the pitch diameter of the cylindrical planet gears is controlled by the unitary carrier member means for rotatably supporting said cylindrical planet gears.

16. An automatic washer according to claim 9 wherein said plurality of cylindrical planet gears, said unitary carrier member and said gear housing are all formed from plastic resins having equivalent coefficients of thermal expansion such that the spacing between the components remains constant over a range of temperatures.

17. A gear reduction mechanism comprising:

a rotary input drive shaft;

a sun gear interconnected with said input drive shaft;

a plurality of cylindrical planet gears engaging said sun gear;

an output vertical shaft;

a unitary carrier member having a plurality of cylindrical hollow pin portions for rotatably supporting said cylindrical planet gears and further having means for interconnecting with said output vertical shaft for causing rotation of said output vertical shaft; and a gear housing having an internal gear ring surrounding said cylindrical planet gears, said plurality of cylindrical planet gears engaging said internal gear ring member.

18. A gear reduction mechanism according to claim 17 wherein 2 said unitary carrier member further comprises:

a plate portion extending outwardly in the radial direction with respect to said output vertical shaft;

said plurality of cylindrical pin portions extending from said plate portion in the longitudinal direction with respect to said output vertical shaft, said cylindrical hollow pin portions rotatably supporting said cylindrical planet gears; and a boss portion extending from said plate portion in the longitudinal direction with respect to said output vertical shaft, said boss portion being interconnected with said output vertical shaft for causing rotation of said output vertical shaft.

19. A gear reduction mechanism according to claim 17 wherein said drive shaft has an outer peripheral surface and said sun gear is integrally formed on outer peripheral surface of said drive shaft.

20. A gear reduction mechanism according to claim 17 wherein said gear housing further comprises:

a flange portion; and a cylindrical portion extending from said flange portion in the longitudinal direction with respect to said input drive shaft, said cylindrical portion having an inner peripheral surface, said internal gear ring being formed on said inner peripheral surface.

21. A gear reduction mechanism according to claim 17 wherein each of said plurality of cylindrical planet gears further comprise:

a thin cylindrical wall member having an outer peripheral surface; and a plurality of axially oriented teeth disposed on said outer peripheral surface of said thin cylindrical wall member.

22. A gear reduction mechanism according to claim 21 wherein each of said plurality of cylindrical planet gears are formed from a plastic resin and are configured such that said thin cylindrical wall deforms during operation such that the pitch diameter of the cylindrical planet gears is controlled by the unitary carrier member means for rotatably supporting said cylindrical planet gears.

23. A gear reduction mechanism according to claim 17 wherein said plurality of cylindrical planet gears, said unitary carrier member and said gear housing are all formed from plastic resins having equivalent coefficients of thermal expansion such that the spacing between the components remains constant over a range of temperatures.

* * * * *